US010111575B2

(12) United States Patent
Torrentes et al.

(10) Patent No.: US 10,111,575 B2
(45) **Date of Patent: *Oct. 30, 2018**

(54) DISHWASHING APPLIANCE HAVING A DOOR LINKAGE ASSEMBLY

(71) Applicant: Haier US Appliance Solutions, Inc., Wilmington, DE (US)

(72) Inventors: Marcelo Torrentes, Louisville, KY (US); Alan Lucas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/423,631

(22) Filed: Feb. 3, 2017

(65) Prior Publication Data

US 2018/0220864 A1 Aug. 9, 2018

(51) Int. Cl.
*A47L 15/00* (2006.01)
*A47L 15/42* (2006.01)

(52) U.S. Cl.
CPC ..... *A47L 15/4261* (2013.01)

(58) Field of Classification Search
CPC ..... Y10T 292/0894; Y10T 292/0902; Y10T 292/0905; Y10T 292/301; Y10T 292/305; Y10T 292/45; Y10T 292/47; Y10T 292/42; Y10T 292/438; Y10T 292/444; Y10T 24/3918; E05C 19/06
USPC ..... 16/78; 312/319.2, 327, 328; 248/74.2
See application file for complete search history.

(56) References Cited

U.S. PATENT DOCUMENTS 1,340,070 A * 5/1920 Markham ..... D06F 57/00 16/257
3,491,971 A * 1/1970 Fisher ..... F16L 3/13 24/339
4,944,551 A * 7/1990 Hardy, Jr. ..... B60J 7/062 160/267.1
4,988,149 A 1/1991 Mulder et al.
6,427,500 B1 * 8/2002 Weinerman ..... B60J 7/198 292/196
6,774,302 B2 * 8/2004 Conte ..... H02G 1/04 174/40 R
7,699,064 B2 4/2010 Schlief et al.
(Continued)

FOREIGN PATENT DOCUMENTS

DE 102012211254 * 1/2014
EP 1952748 B1 12/2010
WO WO2006137039 A2 12/2006

*Primary Examiner* — Janet M Wilkens
(74) *Attorney, Agent, or Firm* — Dority & Manning, P.A.

(57) ABSTRACT

An appliance, such as a dishwashing appliance having a door linkage assembly is generally provided herein. The dishwashing appliance may include a cabinet, a tub, a door, a spring linkage, and a linkage latch. The tub may be disposed inside the cabinet and define a front opening. The door may be rotatably positioned at the front opening. The spring linkage may bias the door toward a closed position. The spring linkage may extend from a first end to a second end. The first end may be mounted to the cabinet. The second end may include a fastener that is selectively attached to the door. The linkage latch may extend laterally from one of a pair of opposing sidewalls below the door. The linkage latch may define a latch channel to selectively receive the spring linkage when the fastener is detached from the door.

12 Claims, 6 Drawing Sheets

(56) References Cited

U.S. PATENT DOCUMENTS

| | | | | |
|---|---|---|---|---|
| 7,746,628 | B2 * | 6/2010 | Takayanagi | G06F 1/1616 16/221 |
| 7,870,753 | B2 | 1/2011 | Marcy et al. | |
| 7,934,783 | B2 * | 5/2011 | Van Vooren | A47L 15/4261 312/228 |
| 8,226,150 | B1 * | 7/2012 | Schmeichel | B60P 7/04 296/100.15 |
| 8,828,148 | B2 | 9/2014 | Poyner et al. | |
| 9,072,422 | B2 | 7/2015 | Kozinski et al. | |
| 9,155,444 | B2 | 10/2015 | Lee | |
| 9,642,511 | B2 * | 5/2017 | Shoup | A47L 15/4261 |
| 2004/0113531 | A1 | 6/2004 | Raches | |
| 2008/0122331 | A1 * | 5/2008 | Haeberle | A47L 15/4261 312/319.1 |
| 2008/0272678 | A1 * | 11/2008 | Tynes | A47L 15/4261 312/319.4 |
| 2011/0241507 | A1 * | 10/2011 | Diebold | A47L 15/4261 312/228 |
| 2014/0375192 | A1 * | 12/2014 | Haft | E05D 13/1207 312/319.2 |
| 2017/0086645 | A1 * | 3/2017 | Shoup | A47L 15/4261 |

* cited by examiner

DISHWASHING APPLIANCE HAVING A DOOR LINKAGE ASSEMBLY

FIELD OF THE INVENTION

The present subject matter relates generally to appliances, and more particularly to dishwashing appliances having a linkage assembly for in-situ removal of a door from an installed dishwashing appliance.

BACKGROUND OF THE INVENTION

Dishwasher appliances generally include a tub that defines a wash chamber for receipt of articles for washing. A door provides for selective access to the wash chamber. For example, the door can be rotatably mounted to the wash tub with a hinge. The door can selectively adjust between an open and a closed position by rotating about the hinge in order to permit access to the wash chamber.

Typically, removal of a dishwasher door requires the hinge arms to disconnect from the door while the hinges stay connected to the tub and spring system. In order to maintain proper door stiffness in relation to the hinge arms, the hinge arms must stay connected to the door during removal of the door. This requires removal of the entire dishwasher from the cabinet in order to access the spring linkage and remove the door. Removal of the entire dishwasher from the cabinet is undesirable because of, for example, the additional labor involved with removing and reinstalling the appliance in the cabinet and accidental damage to cabinets and floors. Moreover, removing the door may require angling the door, which may add potential energy to door balance system. This increase in potential energy may create a safety risk and increase the difficulty for door removal.

Accordingly, a need arises for an appliance that allows for easy removal of the door. It may also be advantageous to provide dishwashing appliances that allow for removal of the dishwasher door without requiring removal of the dishwasher from the cabinet. Moreover, it may be especially advantageous to provide a dishwashing appliance wherein tension may be maintained in a balance assembly even when the balance assembly is not attached to the door.

BRIEF DESCRIPTION OF THE INVENTION

Aspects and advantages of the invention will be set forth in part in the following description, or may be obvious from the description, or may be learned through practice of the invention.

In one aspect of the present disclosure, a dishwashing appliance is provided. The dishwashing appliance may include a cabinet, a tub, a door, a spring linkage, and a linkage latch. The cabinet may define a wash chamber for the receipt of articles for washing. The cabinet may include a pair of opposing sidewalls, a top wall, and a rear wall. The tub may be disposed inside the cabinet and define a front opening. The door may be rotatably positioned at the front opening and provide selective access to the wash chamber of the cabinet. The spring linkage may bias the door toward a closed position. The spring linkage may extend from a first end to a second end. The first end may be mounted to the cabinet. The second end may include a fastener that is selectively attached to the door. The linkage latch may extend laterally from one of the pair of opposing sidewalls below the door along a vertical direction. The linkage latch may define a latch channel to selectively receive the spring linkage when the fastener is detached from the door.

In another aspect of the present disclosure, an appliance is provided. The appliance may include cabinet that define a chamber, a door, a hinge, a spring linkage, and a linkage latch. The door may be removably mounted to the cabinet and provide selective access to the chamber of the cabinet. The hinge may be rotationally fixed to the door. The spring linkage may extend from a first end to a second end. The first end may be mounted to the cabinet. The second end may include a fastener that is selectively coupled to the hinge. The linkage latch may be mounted to the cabinet below the hinge along the vertical direction. The linkage latch may define a latch channel that may selectively receive the spring linkage upon decoupling of the second end from the hinge.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
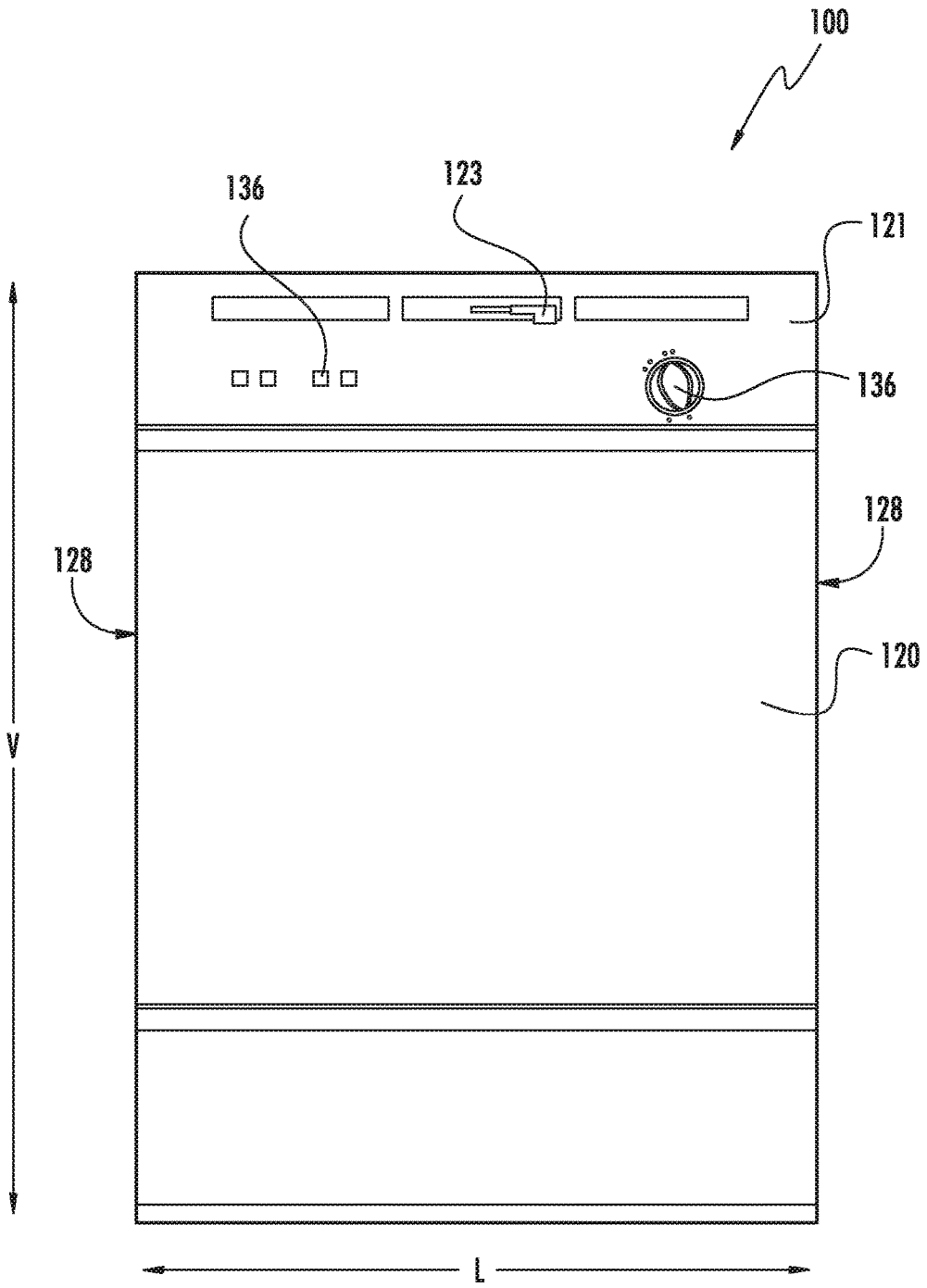
FIG. 1 provides a front view of a dishwashing appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides an appliance that has a rotating door that is removably coupled to a cabinet of the appliance. A spring linkage is selectively attached to door, e.g., to provide a counter-balance force for door rotation. A linkage latch is provided to receive the spring linkage when the spring linkage is decoupled or not attached to the door.

Figure 2:
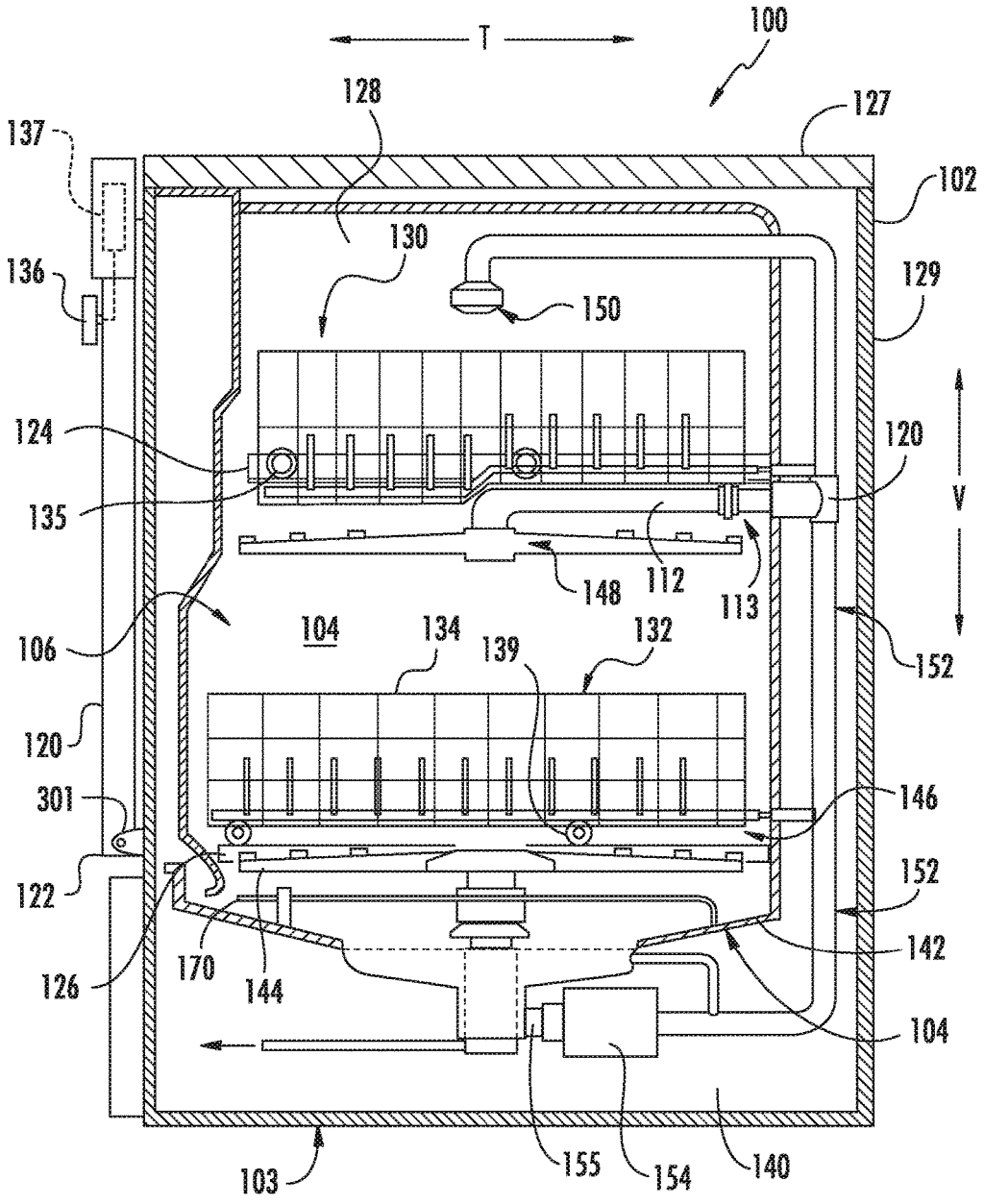
FIG. 2 proves a cross-sectional side view of the example dishwashing appliance of FIG. 1.

FIGS. 1 and 2 depict an example domestic dishwasher appliance 100 that may be configured in accordance with aspects of the present disclosure. Mutually-orthogonal lateral direction L, transverse direction T, and vertical direction V are shown in the figures. For the particular embodiment of FIGS. 1 and 2, the dishwasher 100 includes a cabinet 102 having a tub 104 therein that defines a wash chamber 106. The tub 104 includes a front opening and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 123 is used to lock and unlock door 120 for access to wash chamber 106. The cabinet 102 includes a pair of opposing sidewalls 128, a top wall 127, and a rear wall 129. A tub 104 is disposed inside the cabinet 102 and configured with a front opening for receipt of a door 120 hinged at its bottom 122.

Upper and lower guide rails 124, 126 are mounted on tub sidewalls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above upper rack 130. Although a stationary spray assembly 150 is shown, an upper spray arm assembly may be used as well. Other fluid emitting devices for cleaning articles may be used at the lower, middle, and/or upper positions as well.

The lower and mid-level spray-arm assemblies 144, 148 and the upper spray assembly 150 are in fluid communication with a pump 154 and a main supply conduit 152 for circulating fluids (e.g., wash or rinse) in the tub 104. The main supply conduit 152 is served by a recirculation pump 154 positioned in a machinery compartment 140 located below the tub sump portion 142 (i.e., bottom wall) of the tub 104, as generally recognized in the art. Pump 154 receives fluid from sump 142 to provide a flow to the main supply conduit 152. A heating element 170 can be used to provide heat during e.g., a drying cycle.

Each spray-arm assembly 144, 148 includes an arrangement of discharge ports or orifices for directing washing fluid received from pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 using fluid from pump 154 provides coverage of dishes and other dishwasher contents with a washing spray. Other configurations of spray assemblies may be used as well.

The middle spray-arm assembly 148 is releasably connected with fluid supply conduit 152 by way of a diverter 200 as further described herein. Specifically, as rack 130 is moved in and out of chamber 106, fluid supply conduit 112 releasably connects or disconnects from diverter 200. Other configurations may also be used.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of domestic appliance. The exemplary embodiment depicted in FIGS. 1 and 2 is for illustrative purposes only. For example, different locations may be provided for user interface 136, different configurations may be provided for racks 130, 132, different spray devices and spray arm assemblies may be used, and other differences may be applied as well.

Figure 3:
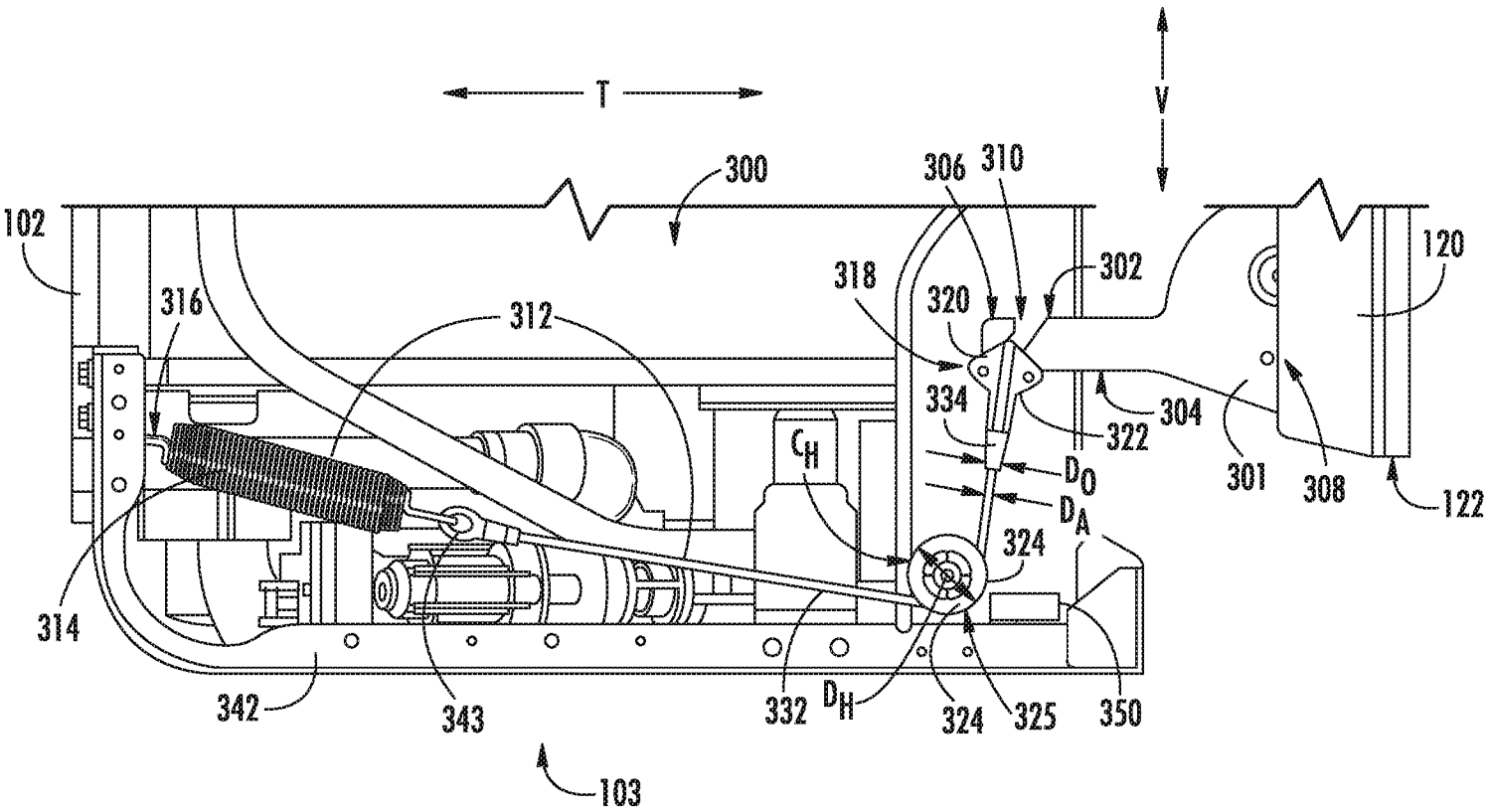
FIG. 3 is a side view of a balance assembly in an appliance according to example embodiments of the present disclosure.
Figure 4:
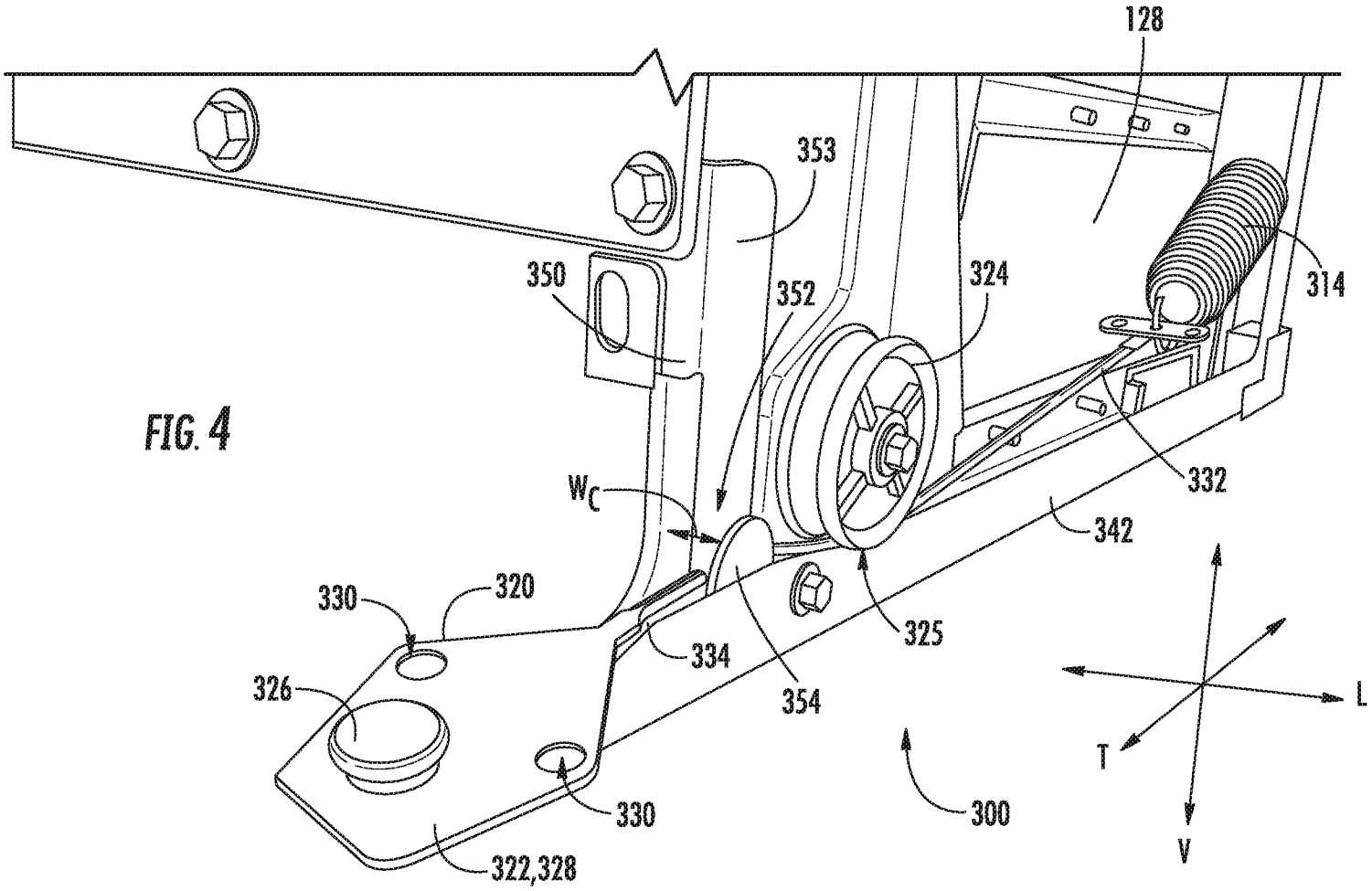
FIG. 4 is a perspective view of the example balance assembly of FIG. 3 when spring linkage is received by a linkage latch.

FIGS. 3 and 4 show an example balance assembly 300. As shown in FIG. 3, balance assembly 300 may attach door 120 to cabinet 102. A pair of hinges 301 is disposed proximate to opposing sidewalls 128 of cabinet 102. Each hinge 301 generally defines a top edge 302, bottom edge 304, hinge distal end 306, and hinge proximal end 308. In some embodiments, the hinge proximal end 308 is removably coupled to the door 120. As shown, each hinge 301 extends from door 120 toward cabinet 102. When assembled, each hinge 301 is rotationally fixed to door 120, e.g., via an adhesive or a mechanical attachment member, such as a screw or clip. As door 120 rotates, each hinge 301 may thus rotate with door 120.

The hinge distal end 306 is spaced apart along the transverse direction T from hinge proximal end 308. In some embodiments, hinge distal end 306 defines a groove 310 that generally extends in the vertical direction V, e.g., when door 120 is in the closed position. For instance, groove 310 may be defined such that groove 310 extends vertically downward from top edge 302 toward bottom edge 304. In the illustrated embodiments, groove 310 terminates before reaching bottom edge 304. In other words, groove 310 may be open to top edge 302, but closed to bottom edge 304. Optionally, groove 310 may be defined at an angle relative to vertical direction V, e.g., in the general direction of door 120 away from cabinet 102.

At least one spring linkage 312 is coupled to one hinge 301. Generally, spring linkage 312 attaches hinge 301 to cabinet 102 and biases door 120 toward the closed position. As shown, spring linkage 312 extends from a first end 316 to a second end 318. In some embodiments, first end 316 is mounted to cabinet 102. Second end 318 may be selectively attached to door 120.

In certain embodiments, a fastener 320 is fixed to spring linkage 312, e.g., at second end 318. When assembled, fastener 320 selectively attaches door 120 to spring linkage 312. For example, fastener 320 may include a rigid body 322 and a groove leg 326. Groove leg 326 may extend from rigid body 322 and be sized to fit within groove 310 of hinge 301. Specifically, when received by groove 310, groove leg 326 may extend in the lateral direction L from a flange 328 of rigid body 322. Optionally, groove leg 326 may be provided as a clevis member. Moreover, groove leg 326 may selectively slide in and out of groove 310, e.g., as directed by a user or installer attaching and/or detaching fastener 320 from hinge 301.

Optionally, rigid body 322 may define one or more bore holes 330. Specifically, a bore hole 330 may be defined through the flange 328 of rigid body 322. Each bore hole 330 may be formed for complementary receipt of a linkage removal tool (not pictured). When assembled, linkage removal tool may thus gain access to the fastener 320 from the front of the dishwasher after removal of a dishwasher toekick panel. A collar 334 extends from flange 328 of rigid body 322 in some embodiments, e.g., in the direction of the first end 316.

As shown, certain embodiments of spring linkage 312 include a tension spring 314, e.g., coil spring. When assembled, tension spring 314 may elastically stretch from the closed position to the open position. Conversely, tension spring 314 may contract from the open position to the closed position, e.g., as tension spring 314 biases door 120 toward the closed position. Tension spring 314 may be positioned to generally extend along a portion of spring linkage 312, e.g., between the first end 316 and the second end 318. In some embodiments, tension spring 314 is coupled to cabinet 102 at first end 316. For instance, tension spring 314 may include a hook received by an aperture defined through a frame 342 of cabinet 102. Although only shown as a sub-portion of the length between the first end 316 and the second end 318, alternative embodiments of tension spring 314 may extend fully as the entirety of spring linkage 312 from first end 316 to second end 318, e.g., such that fastener 320 extends directly from tension spring 314.

In some embodiments, spring linkage 312 includes a cable 332, e.g., wound steel cable 332. In the illustrated embodiments, cable 332 is fixed to fastener 320. Cable 332 may also be fixed to tension spring 314. Specifically, cable 332 may extend along a portion of spring linkage 312 between the tension spring 314 and the fastener 320. In optional embodiments, a cable eyelet 343 is mounted to cable 332 and coupled to tension spring 314. Cable 332 may join to fastener 320 at collar 334. Collar 334 may receive cable 332 such that collar 334 defines a diameter $D_O$ that is greater than the diameter $D_A$ of cable 332. When assembled, tension spring 314 may thus apply tension to cable 332, which in turn pulls on hinge 301 using fastener 320.

In some embodiments, a guide wheel 324 is rotatably mounted to cabinet 102. For instance, guide wheel 324 may be attached to cabinet 102 proximate to one of the pair of opposing sidewalls 128. As shown, guide wheel 324 defines a wheel diameter $D_H$ and circumference $C_H$. When assembled, a portion of spring linkage 312, e.g., cable 332, may be disposed along a portion of the circumference $C_H$ of guide wheel 324. Guide wheel 324 may thus engage a portion of spring linkage 312. Moreover, cable 332 may be directed beneath guide wheel 324, e.g., such that a portion of cable 332 is disposed along a bottom portion 325 of guide wheel 324, e.g., circumference $C_H$ of guide wheel 324. When spring linkage 312 is attached to door 120, cable 332 may be wound along circumference $C_H$ of guide wheel 324 from the bottom portion 325 of guide wheel 324 upward along the vertical direction V toward hinge 301, which may be positioned above guide wheel 324. During use, guide wheel 324 may thus maintain tension on spring linkage 312, e.g., as spring linkage 312 biases door 120 between the open position and the closed position.

A linkage latch 350 is provided below hinge 301 along the vertical direction V. Specifically, linkage latch 350 extends laterally (i.e., in the lateral direction L) away from one of the pair of opposing sidewalls 128 below the door 120 along the vertical direction V. Moreover, linkage latch 350 may be positioned forward from guide wheel 324 along the transverse direction T, e.g., between guide wheel and door 120 along the transverse direction T. In some embodiments, linkage latch 350 attaches to a front portion of cabinet 102, e.g., behind the toekick panel. In some embodiments, linkage latch 350 is positioned to avoid interference with spring linkage 312 when fastener 320 is attached to door 120. Optionally, linkage latch 350 may be positioned below a top portion of guide wheel 324 along the vertical direction V. Further, linkage latch 350 may extend above the bottom portion 325 of guide wheel 324.

Linkage latch 350 is generally positioned receive a portion of spring linkage 312. Specifically, linkage latch 350 is positioned to maintain tension along spring linkage 312 when fastener 320 is detached from hinge 301. In certain embodiments, such as that illustrated by FIG. 4, linkage latch 350 defines a channel 352 that selectively receives spring linkage 312. For instance, channel 352 may receive a portion of spring linkage 312 when fastener 320 is detached from door 120 or hinge 301. In some embodiments, channel 352 is configured (e.g., sized and shaped) to receive cable 332 between a latch body 353 and a latch arm 354. As shown, latch body 353 and latch arm 354 may be formed as a single integral structure (e.g., of a suitable metal or plastic material) that is bent or formed to define channel 352 between latch body 353 and latch arm 354. The diameter $D_O$ of collar 334 may be greater than a width $W_C$ of channel 352. When cable 332 is received within channel 352, collar 334 may thus engage a perimeter edge 356 of linkage latch 350. When fastener 320 is detached from hinge 301, the engagement between fastener 320 and linkage latch 350 may secure spring linkage 312 in tension as, e.g., tension spring 314, biases fastener 320 rearward. Optionally, spring linkage 312 may be directed outside of and away from channel 352 when fastener 320 is attached to door 120 or hinge 301.

Turning now to FIGS. 5 through 8, further alternative embodiments of linkage latch 350 are provided. It is understood that, except as otherwise indicated, the embodiments of FIGS. 5 through 8 may be substantially identical to the embodiment described above. For instance, as shown in the illustrated embodiments, linkage latch 350 may be mounted to frame 342 opposite from wash chamber 106 (FIG. 2). Frame 342 generally extends along a bottom portion 103 of cabinet 102, e.g., as a support leg. Moreover, it is understood that a portion of frame 342 may be positioned at each opposing sidewall 128.

Figure 5:
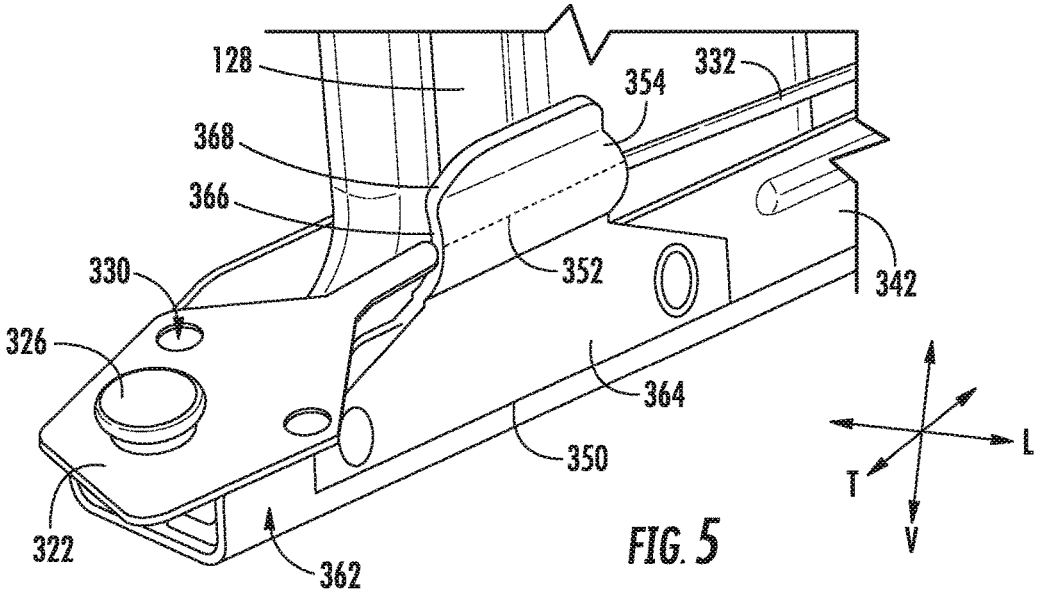
FIG. 5 is a perspective view of a portion of a door balance assembly according to alternative example embodiments of the present disclosure.

Turning specifically to FIG. 5, a linkage latch 350 may be secured to an outer face 362 of frame 342 via one or more mechanical attachment members (e.g., screws, bolts, clips, etc.). Moreover, linkage latch 350 may include a resilient latch arm 354. Resilient latch arm 354 may extend upward in the vertical direction V from a base bracket 364 and selectively hold or engage spring linkage 312 in an interference fit. The channel 352 for receiving a portion of spring linkage 312 (e.g., cable or collar) may be defined between resilient latch arm 354 and one of opposing sidewalls 128. Furthermore, resilient latch arm 354 may include a concave segment 368 sized and shaped along the transverse direction T to compliment spring linkage 312 and define a portion of channel 352. A convex segment 366 of resilient latch arm 354 may be included. The convex segment 366 may be formed along the transverse direction T and above channel 352 to selectively enclose a portion of spring linkage 312. In turn, concave segment 368 may be formed at a position that is between base bracket 364 and convex segment 366 along the vertical direction V.

Figure 6:
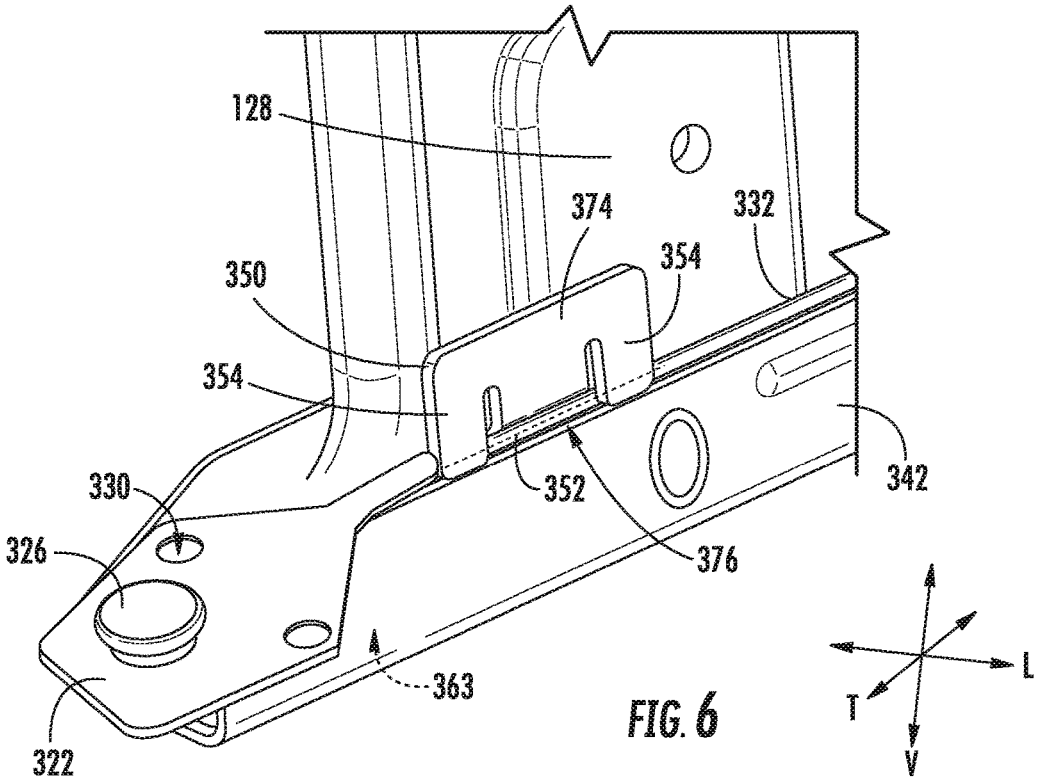
FIG. 6 is a perspective view of a portion of a door balance assembly according to other alternative example embodiments of the present disclosure.

Turning specifically to FIG. 6, a linkage latch 350 may be secured to an inner face 363 of frame 342 via one or more mechanical attachment members (e.g., screws, bolts, clips, etc.). Moreover, linkage latch 350 may include a pair of resilient latch arms 354. Resilient latch arms 354 may extend downward in the vertical direction V from an upper tab 374 and selectively hold or engage spring linkage 312 in an interference fit. Each latch arm 354 may be positioned on opposite transverse portion of upper tab 374. A recess 376 is defined below upper tab 374 and between the two latch arms 354 along the transverse direction T. The channel 352 for receiving a portion of spring linkage 312 (e.g., cable or collar) may be defined between resilient latch arms 354 and the recess 376.

Figure 7:
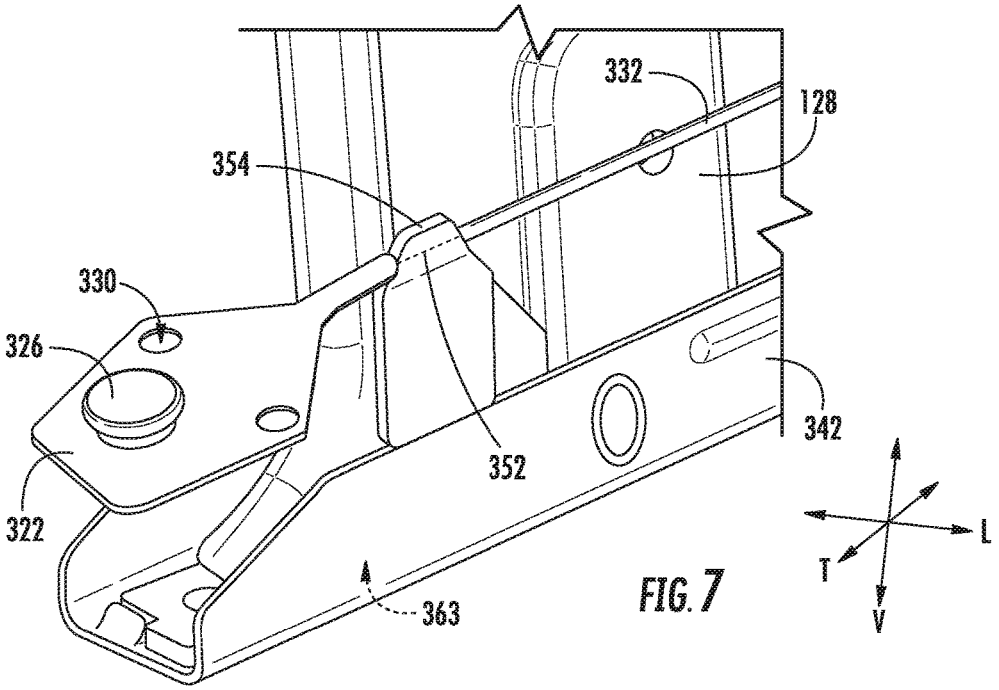
FIG. 7 is a perspective view of a portion of a door balance assembly according to further alternative example embodiments of the present disclosure.

Turning specifically to FIG. 7, a linkage latch 350 may be secured to an inner face 363 of frame 342 via one or more mechanical attachment members (e.g., screws, bolts, clips, etc.). Moreover, linkage latch 350 may include a resilient latch arm 354. Resilient latch arm 354 may extend upward in the vertical direction V from a base bracket 364 and selectively hold or engage spring linkage 312 in an interference fit. Moreover, resilient latch arm 354 may be and arcuate member extending generally away from cabinet along the lateral direction L. The channel 352 for receiving a portion of spring linkage 312 (e.g., cable or collar) may be defined between resilient latch arm 354 and one of opposing sidewalls 128.

Figure 8:
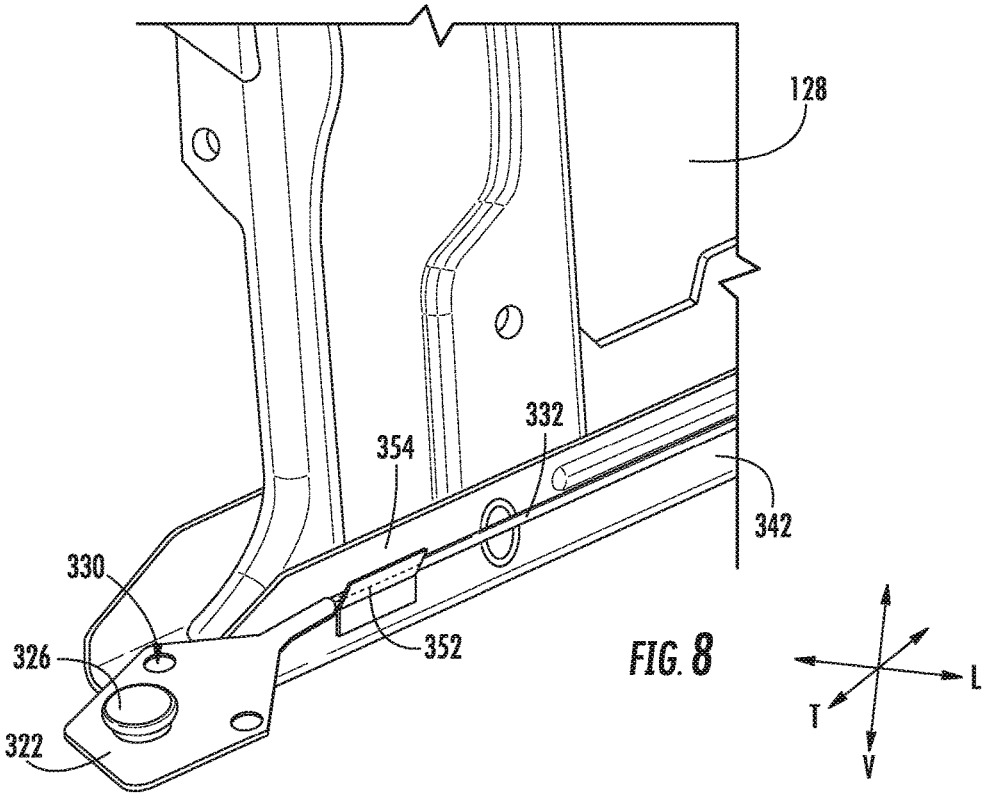
FIG. 8 is a perspective view of a portion of a door balance assembly according to still further alternative example embodiments of the present disclosure.

Turning specifically to FIG. 8, a linkage latch 350 may be formed from frame 342. A resilient latch arm 354 may extend as an integral cutout extending laterally from frame 342. Resilient latch arm 354 may extend upward in the vertical direction V and selectively hold or engage spring linkage 312 in an interference fit. Moreover, resilient latch arm 354 may be and arcuate member extending generally away from cabinet along the lateral direction L. The channel 352 for receiving a portion of spring linkage 312 (e.g., cable or collar) may be defined between resilient latch arm 354 and frame 342.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a mutually-orthogonal vertical direction, lateral direction, and transverse direction, the dishwashing appliance comprising:

a cabinet defining a wash chamber for the receipt of articles for washing, the cabinet comprising a pair of opposing sidewalls, a top wall, and a rear wall;

a tub disposed inside the cabinet and defining a front opening;

a door rotatably positioned at the front opening and providing selective access to the wash chamber of the cabinet;

a spring linkage biasing the door toward a closed position, the spring linkage extending from a first end to a second end, the first end being mounted to the cabinet, the second end including a fastener selectively attached to the door;

a linkage latch extending laterally from one of the pair of opposing sidewalls below the door along the vertical direction, the linkage latch defining a latch channel to selectively receive the spring linkage when the fastener is detached from the door; and a guide wheel rotatably mounted to the cabinet, wherein the guide wheel defines a diameter extending from a top portion to a bottom portion, wherein the spring linkage is disposed along the bottom portion of the guide wheel, and wherein the linkage latch is positioned between the top portion and the bottom portion of the guide wheel along the vertical direction to maintain tension on the spring linkage when the fastener is received at the linkage latch, wherein the fastener includes a rigid body defining a bore hole to receive a linkage removal tool.

2. The dishwashing appliance of claim 1, wherein the spring linkage includes a tension spring extending along a portion of the spring linkage between the first end and the second end.

3. The dishwashing appliance of claim 2, wherein the spring linkage further includes a cable extending along a portion of the spring linkage between the tension spring and the fastener.

4. The dishwashing appliance of claim 1, the washing machine appliance further comprising a hinge extending from the door toward the cabinet, wherein the fastener further includes a groove leg, and wherein the groove leg is selectively received by the hinge.

5. The dishwashing appliance of claim 1, wherein the linkage latch includes a resilient latch arm, and wherein the resilient latch arm engages the spring linkage in an interference fit.

6. The dishwashing appliance of claim 1, wherein the cabinet includes a frame extending along a bottom portion of the cabinet, and wherein the linkage latch is mounted to the frame opposite from the wash chamber along the lateral direction.

7. An appliance defining a vertical direction, the appliance comprising:

a cabinet defining a chamber;

a door removably mounted to the cabinet, the door providing selective access to the chamber of the cabinet;

a hinge rotationally fixed to the door;

a spring linkage extending from a first end to a second end, the first end being mounted to the cabinet, the second end including a fastener selectively coupled to the hinge;

a linkage latch mounted to the cabinet below the hinge along the vertical direction, the linkage latch defining a latch channel to selectively receive the spring linkage upon decoupling of the second end from the hinge; and a guide wheel rotatably mounted to the cabinet, wherein the guide wheel defines a diameter extending from a top portion to a bottom portion, wherein the spring linkage is disposed along the bottom portion of the guide wheel, and wherein the linkage latch is positioned between the top portion and the bottom portion of the guide wheel along the vertical direction to maintain tension on the spring linkage when the fastener is received at the linkage latch, wherein the fastener includes a rigid body defining a bore hole to receive a linkage removal tool.

8. The appliance of claim 7, wherein the spring linkage includes a tension spring extending along a portion of the spring linkage between the first end and the second end.

9. The appliance of claim 8, wherein the spring linkage further includes a cable extending along a portion of the spring linkage between the tension spring and the fastener.

10. The appliance of claim 7, wherein the fastener further includes a groove leg, wherein the groove leg is selectively received by the hinge.

11. The appliance of claim 7, wherein the linkage latch includes a resilient latch arm, and wherein the resilient latch arm engages the spring linkage in an interference fit.

12. The appliance of claim 7, wherein the appliance further defines a lateral direction and a transverse direction orthogonal, each of the vertical direction, lateral direction, and transverse direction being orthogonal to each other, wherein the cabinet includes a frame positioned below the wash chamber along the vertical direction, and wherein the linkage latch is mounted to the frame opposite from the wash chamber along the lateral direction.

* * * * *